US009333776B2

(12) United States Patent
Block et al.

(10) Patent No.: US 9,333,776 B2
(45) Date of Patent: May 10, 2016

(54) CARTRIDGE FOR LABEL PRINTER

(71) Applicant: Esselte IPR AB, Solna (SE)

(72) Inventors: David Block, El Cerrito, CA (US); Matthew M. Taylor, Mountain View, CA (US); J. G. Goldberg, Menlo Park, CA (US); Robert A. Riccomini, Saratoga, CA (US); Chris Whittall, Los Gatos, CA (US); Ariel D. Turgel, San Francisco, CA (US); Zachary G. Stephanchick, San Jose, CA (US)

(73) Assignee: Esselte IPR AB (SE)

( * ) Notice: Subject to any disclaimer, the term of this patent is extended or adjusted under 35 U.S.C. 154(b) by 0 days.

(21) Appl. No.: 14/333,259

(22) Filed: Jul. 16, 2014

(65) Prior Publication Data

US 2015/0022611 A1 Jan. 22, 2015

Related U.S. Application Data

(60) Provisional application No. 61/846,926, filed on Jul. 16, 2013, provisional application No. 61/846,931, filed on Jul. 16, 2013.

(51) Int. Cl.
*B41J 2/00* (2006.01)
*B41J 15/04* (2006.01)

(52) U.S. Cl.
CPC ..... *B41J 15/044* (2013.01)

(58) Field of Classification Search
CPC ..... B41J 2/0057; B41J 3/4076; B41J 25/308; B41J 25/3088; B41J 29/393
USPC ..... 347/110
See application file for complete search history.

(56) References Cited

U.S. PATENT DOCUMENTS

| | | | |
|---|---|---|---|
| D216,281 | S | 12/1969 | Moyroud |
| 4,239,404 | A | 12/1980 | DeFilipps et al. |
| 4,439,257 | A | 3/1984 | Sato et al. |
| D275,966 | S | 10/1984 | Worrell |
| 4,535,463 | A | 8/1985 | Ito et al. |
| 4,591,404 | A | 5/1986 | Hamisch, Jr. |

(Continued)

FOREIGN PATENT DOCUMENTS

| | | |
|---|---|---|
| CN | 301199988 | 5/2010 |
| EP | 0297567 A2 | 1/1989 |

(Continued)

OTHER PUBLICATIONS

Baxter, R., (Dec. 1985) "Bar coding pays off for case", Production Engineer, *Journal of the Institution of Production Engineers*, vol. 64, No. 11, pp. 15-17.

(Continued)

*Primary Examiner* — Manish S Shah
*Assistant Examiner* — Yaovi Ameh
(74) *Attorney, Agent, or Firm* — Goodwin Procter LLP

(57) ABSTRACT

In one embodiment, a cartridge body for a cartridge for providing media to a printer includes a first part and a complimentary second part, the first part and the second part formed of post-consumer-material; a hinge integrally connected to the first part and the second part and adapted to close the first part and the second part together over the media and contain the media therein; and an opening formed by the closed first part and second part for dispensing the media to the printer. A cartridge is also disclosed.

31 Claims, 9 Drawing Sheets

(56) References Cited

U.S. PATENT DOCUMENTS 4,623,418 A 11/1986 Gombrich et al.
4,690,344 A * 9/1987 Yokota ..... 242/564.1
4,712,929 A 12/1987 Kitaoka
4,718,784 A 1/1988 Drisko
D295,535 S 5/1988 Reinke
4,765,765 A 8/1988 Futakata
4,797,018 A 1/1989 Hofmann et al.
4,807,177 A 2/1989 Ward
4,823,953 A 4/1989 Anderson et al.
4,838,713 A 6/1989 Kunimitsu et al.
4,911,566 A 3/1990 Imaseki et al.
4,918,464 A * 4/1990 Isshiki ..... 347/215
4,937,628 A 6/1990 Cipolla et al.
4,994,853 A 2/1991 Fukuchi et al.
5,014,073 A 5/1991 Sone et al.
5,025,397 A 6/1991 Suzuki
5,078,523 A 1/1992 McGourty et al.
5,087,979 A 2/1992 Schaertel
5,159,681 A 10/1992 Beck et al.
5,169,249 A 12/1992 Kitabata
5,176,458 A 1/1993 Wirth
5,181,787 A 1/1993 Hosomi
5,247,325 A 9/1993 Takahashi
5,253,334 A 10/1993 Kimura et al.
5,265,966 A 11/1993 Schmidt
5,266,972 A 11/1993 Gotho et al.
5,269,612 A 12/1993 Shimoha et al.
5,276,461 A 1/1994 Saito
5,297,876 A 3/1994 Imagawa
5,314,256 A 5/1994 Niwa
5,318,370 A 6/1994 Nehowig
5,322,375 A 6/1994 Niwa et al.
5,322,378 A 6/1994 Ikeda et al.
5,344,247 A 9/1994 Sakuragi et al.
5,362,008 A * 11/1994 Nagel et al. ..... 242/417
5,399,030 A 3/1995 Niwa et al.
5,424,757 A 6/1995 Thom
5,483,623 A 1/1996 Nagashima
5,488,223 A 1/1996 Austin et al.
5,489,971 A 2/1996 Nam
5,492,420 A 2/1996 Nunokawa et al.
5,521,627 A 5/1996 Keung et al.
5,559,934 A 9/1996 Ogura et al.
5,585,941 A 12/1996 Maemura
5,598,279 A 1/1997 Ishii et al.
5,605,404 A 2/1997 Nunokawa et al.
5,621,864 A 4/1997 Benade et al.
5,643,395 A 7/1997 Hinton
5,658,083 A 8/1997 Day et al.
5,677,999 A 10/1997 Hidaka et al.
5,680,223 A 10/1997 Cooper et al.
5,715,379 A 2/1998 Pavlovic et al.
5,721,813 A 2/1998 Leinhos
5,731,879 A 3/1998 Maniwa et al.
5,758,039 A 5/1998 Shibata et al.
5,760,814 A 6/1998 Kang
5,806,993 A 9/1998 Petterutti et al.
5,816,717 A 10/1998 Beadman et al.
5,823,689 A 10/1998 Nehowig et al.
5,823,693 A 10/1998 Henderson et al.
5,826,995 A 10/1998 Day et al.
5,864,652 A 1/1999 Murahashi
D407,751 S 4/1999 Zimmermann
5,892,892 A 4/1999 Popat et al.
5,895,157 A 4/1999 Morimura et al.
5,911,380 A 6/1999 Shiba
5,918,898 A 7/1999 Wallner et al.
5,918,989 A 7/1999 Stout, Jr. et al.
5,995,774 A 11/1999 Applegate et al.
6,016,386 A 1/2000 Nosaki et al.
6,059,469 A 5/2000 Hirumi
6,089,765 A 7/2000 Mori
6,106,170 A 8/2000 Watanabe et al.
6,152,623 A 11/2000 Palmer et al.
6,271,989 B1 8/2001 Tannert
6,281,989 B1 8/2001 Tomida
6,322,067 B1 * 11/2001 Fujii et al. ..... 271/145
6,364,552 B1 4/2002 Nehowig et al.
6,367,992 B1 4/2002 Aruga et al.
6,425,700 B1 7/2002 Silverbrook et al.
D466,150 S 11/2002 Matsumoto et al.
6,503,005 B1 1/2003 Cockerill et al.
6,565,181 B2 5/2003 Silverbrook
6,609,844 B1 8/2003 Petteruti et al.
D481,414 S 10/2003 Milton et al.
6,702,417 B2 3/2004 Silverbrook
6,812,943 B1 11/2004 Day et al.
6,835,013 B2 12/2004 Dunn et al.
6,857,801 B2 2/2005 Van Bever
6,890,113 B2 5/2005 Block
D507,523 S 7/2005 Resch et al.
6,954,254 B2 10/2005 Silverbrook
7,044,589 B2 5/2006 Silverbrook
7,066,588 B2 6/2006 Silverbrook et al.
7,077,515 B2 7/2006 Silverbrook
7,140,791 B2 11/2006 Van Bever
D533,831 S 12/2006 Kim
D538,333 S 3/2007 Nakajima et al.
D575,729 S 8/2008 Nomi et al.
D581,943 S 12/2008 Pedersen et al.
7,470,014 B2 12/2008 Silverbrook et al.
D594,504 S 6/2009 Hattori
D610,607 S 2/2010 Kachi et al.
7,722,172 B2 5/2010 Silverbrook
7,789,501 B2 9/2010 Silverbrook
D632,648 S 2/2011 Yang
D636,813 S 4/2011 Kikuchi et al.
D637,552 S 5/2011 Inman et al.
D640,735 S 6/2011 Kimura et al.
D643,807 S 8/2011 Jiang
7,990,567 B2 8/2011 Vleurinck et al.
D648,676 S 11/2011 Brookshire et al.
D656,537 S 3/2012 Van Den Broecke et al.
D659,186 S 5/2012 Okamoto et al.
D659,751 S 5/2012 Okamoto et al.
D660,787 S 5/2012 Lambert et al.
D661,344 S 6/2012 Okamoto et al.
D663,767 S 7/2012 Inada
D669,427 S 10/2012 Ignor et al.
D675,254 S 1/2013 Kubota et al.
D675,255 S 1/2013 Kubota et al.
D678,188 S 3/2013 Sasada
D682,777 S 5/2013 Gupta et al.
8,469,507 B2 6/2013 Fukui
D686,152 S 7/2013 Lee et al.
D694,319 S 11/2013 Nakagawa
D694,817 S 12/2013 Adam et al.
D697,865 S 1/2014 Saito et al.
D699,177 S 2/2014 Higashi
D701,898 S 4/2014 Nakata et al.
D705,719 S 5/2014 Wong
D706,341 S 6/2014 Kano et al.
D708,129 S 7/2014 Houghton et al.
D709,823 S 7/2014 Corley et al.
D712,457 S 9/2014 Koshimori et al.
D715,356 S 10/2014 Nakagawa et al.
D717,243 S 11/2014 Liu et al.
D719,086 S 12/2014 Lee et al.
D720,687 S 1/2015 Hasbrook
D721,646 S 1/2015 Kim
D722,018 S 2/2015 Wang
D728,467 S 5/2015 Hasbrook
D733,043 S 6/2015 Hasbrook et al.
D733,051 S 6/2015 Wang
D740,881 S 10/2015 So et al.
D741,796 S 10/2015 Robinson et al.
2002/0059880 A1 5/2002 Klinefelter et al.
2003/0053109 A1 3/2003 Lester et al.
2004/0090647 A1 5/2004 Beard et al.
2004/0245310 A1 * 12/2004 Masuda et al. ..... 227/134
2005/0156974 A1 * 7/2005 Silverbrook et al. ..... 347/13
2005/0180795 A1 8/2005 Kurashina
2007/0262141 A1 11/2007 Ito et al.
2008/0219692 A1 * 9/2008 Kondo et al. ..... 399/83

(56) References Cited

U.S. PATENT DOCUMENTS

| | | | | |
|---|---|---|---|---|
| 2009/0148222 | A1 | 6/2009 | Terry et al. | |
| 2013/0155459 | A1* | 6/2013 | Jeong et al. | 358/1.15 |
| 2014/0050961 | A1 | 2/2014 | Enari et al. | |

FOREIGN PATENT DOCUMENTS

| | | | |
|---|---|---|---|
| EP | 1066969 | A2 | 1/2001 |
| EP | 1849614 | A2 | 10/2007 |
| FR | 2736863 | A1 | 1/1997 |
| FR | 2778141 | A1 | 11/1999 |
| JP | S58128886 | | 8/1984 |
| JP | 1161122 | | 2/1991 |
| JP | 6024627 | | 9/1995 |
| JP | 10149268 | | 12/1999 |
| JP | 10305944 | | 5/2000 |
| JP | 4115979 | B2 | 7/2008 |
| JP | 2011255609 | A | 12/2011 |
| WO | WO-2009071685 | A1 | 6/2009 |
| WO | WO-2015009849 | A1 | 1/2015 |
| WO | WO-2015009860 | A1 | 1/2015 |

OTHER PUBLICATIONS

Brother Corporation, "Internet Archive: Wayback Machine", Brother at your side, P-Touch Products (2 pages).
Brother Corporation, "P-Touch 9200DX (Model: PT-9200DX): Quick Reference" (40 pages).
Brother Corporation, "P-Touch Editor Version 3.1", Basic Operation, Reference and Index, (203 pages).
Casio Computer Co., Ltd., (2002) "TDK LPCW-50 CD/DVD label printer application version 1.0 for Windows User's Guide", (85 pages).
Coates, J., (Mar. 10, 1996) "AddressMate Plus Produced by CoStar Corp. For . . . ", Software Spotlight, *Chicago Tribune*, (3 pages). Last accessed Feb. 5, 2015 at: <http://articles.chicagotribune.com/1996-03-10/business/9603100068_1_ami-pro-microsoft-word-mailing-labels>.
CoStar Corporation, (1994-1995) "User Manual for AddressMate and AddressMate Plus", AddressMate Plus for Windows User's Manual, (211 pages).
Datamax Corporation, (1999) "Allegro Thermal Printer Maintenance Manual", (162 pages).
Duncan, J., (Jan. 18, 1993), "Windows databases for end-uses", ProQuest, (21 pages).
DYMO, (Apr. 18, 2001) "DYMO's LabelWriter Range Eliminates Label Printing Hassles", (2 pages). Last accessed Jan. 16, 2015 at:<http://global.dymo.com/enCA/PressRelease/DYMO_s_LabelWriter_Range.html>.
DYMO, (May 14, 2001) "DYMO Launches New PC/Mac Connected Product Line", (2 pages). Last accessed Jan. 16, 2015 at:<http://global.dymo.com/enCA/PressRelease/DYMO_Launches_New_PC_Mac_Connected_Product_Line.html>.
DYMO, "Dymo Address Labels White (120130 / 30251)", (3 pages). Last accessed Feb. 15, 2015 at: <http://www.labecity.com/DYMO-address-labels-white-120130.html>.
DYMO, "LabelWriter Address labels", (3 pages). Last accessed Feb. 15, 2015 at: <http://global.dymo.com/enGB/LabelAttribute/LabelWriter_Address_labels.html>.
DYMO, "Standard Tapes", (2 pages). Last accessed Feb. 15, 2015 at: <http://global.dymo.com/enGB/LabelsOverview/Standard_Tapes.html>.
DYMO Corporation, (Mar. 2001) "Declaration of Confirmity," LabelWriter User Manual for LabelWriter Model Nos. 300, 330, 330 Turbo, EL40, EL60 and TUrbo, (56 pages).
Erdman, A., et al., (1991) "Mechanism Design: Analysis and Synthesis—vol. I", *Prentice Hall*, 2nd Edition, (4 pages).
Forderer, S., et al, (1999) "Step by Step Microsoft Office 2000 Self-Study Kit", *Microsoft Press*, Catapult, Perspection and ActiveEduction (9 pages).
Gryphon, R., (Oct. 31, 1994) "Approach 3.0 improves speed, ease of use: Lotus' efforts to optimize indexing bring significant increases in query performance", Reviews, *InfoWorld*, (3 pages).
Heller, Stephen R., (Jun. 10, 1991) "Seiko Smart Label Printer", *Computer Software Reviews*, J. Chem. Inf. Computer Science, vol. 31, No. 3, p. 435.
Hewlett-Packard Co., (Apr. 1999) "HP LaserJet 4000 and 4050 Series Printers Service Manual", (394 pages).
International Search Report and Written Opinion for International Patent Application No. PCT/US2014/046883, mailed Oct. 14, 2014 (10 pages).
International Search Report and Written Opinion for International Patent Application No. PCT/US2014/046901, mailed Oct. 21, 2014 (11 pages).
Intermec Corporation, (Nov. 1997) "3240 Bar Code Label Printer", User's Manual, (178 pages).
Intermec Corporation, (Nov. 1996) "4400 Bar Code Label Printer User's Manual", (318 pages).
Intermec Printer AB, (2002) "Intermec EasyCoder 501 XP Bar Code Label Printer—User's Guide", (178 pages).
Intermec Technologies Corporation, (2000) "LabelShop Ultra & Pro Label Design and Printing Software", Product Profile, (2 pages).
Intermec Technologies Corporation, (Sep. 2000) "Intermec EasyCoder F4 Bar Code Label Printer: Installation & Operation", 3rd Edition, (127 pages).
Karlsson, B., (May 2000) "Thermal Printers", Programmer's Reference Labelpoint II Version 4.3x Copyright Markpoint Printer AB, (79 pages).
Lombardi, J., (Feb. 10, 1992), "Windows Word Processors: InfoWorld Tests the Tools and Features in Six of the High-End Graphical Products", ProQuest, (18 pages).
Marshall, P., (Aug. 22, 1994) "Pulling away from the hard fax", Reviews/Product Comparsion, InfoWorld, (12 pages).
Microsoft Corp., (Jun. 7, 1999) "Microsoft Office 2000, an Essential Tool for All Knowledge Workers, Is Available This Week", (4 pages). Last accessed Feb. 5, 2015 at: <http://news.microsoft.com/1999/06/07/microsoft-office-2000-an-essential-tool-for-all-knowledge-workers-is-available-this-week/>.
Rubright, R., (Jan. 24, 1994) "Office Accelerator automates, adds professional polish to correspondence", Reviews/Test Drives, *InfoWorld*, (1 page).
SATO America, Inc., (May 2000) "SATO M-5900RV Direct Thermal Printer: Operator and Technical Reference Manual", (258 pages).
Schwartz, E., (Sep. 14, 1998) "IBM boots PC print management", Client/Server, *InfoWorld*, (1 page).
Stoughton, A., (Dec. 13, 1993) "Q&A flat-file manager moves to Windows: 4.0 features differ from DOS version; offers graphical, quick database query capabilities", Reviews, *InfoWorld*, (4 pages).
Tiplady, B., (1981) "A Basic Program for Constructing a Dispensing List for a Randomised Clinical Trial:", *Letters to the Editors*, Br. J. Clin. Pharmac., vol. 11, pp. 617-618.
Toshiba TEC Corporation, (Nov. 1993) "TEC Thermal Printer B-570 Series Maintenance Manual: Document No. EM18-33010A", (90 pages).
Whipsaw, (Aug. 11, 2014), "Leitz Icon Printer", Last accessed Oct. 5, 2015 at <URL: <http://www.whipsaw.com/work/projects/leitz-icon-printer/>. (4 pages).
YouTube, (Apr. 30, 2014) "Introducing Leitz Icon Smart Labeling System Printer," Last accessed Oct. 6, 2015 at URL: <https://www.youtube.com/watch?v=6QVM_bg7LIQ>, (1 page).
Brother Corporation, "High-Speed Label Printer with Built-in Ethernet and Wireless Networking," Brother QL-720NW brochure, brother at your side, (4 pages).
Brother Corporation, "Quick Setup Guide," Label Printer QL-710W/720NW, (44 pages).
Brother Corporation, "User's Guide," Label Printer QL-710W/720NW, (23 pages).

* cited by examiner

CARTRIDGE FOR LABEL PRINTER

CROSS REFERENCE TO RELATED APPLICATIONS

This application is filed under 35 U.S.C. §111(a), and claims priority under 35 U.S.C. 119(e) to U.S. Patent Application No. 61/846,926, entitled "Cartridge for Label Printer," filed Jul. 16, 2013, and also claims priority to U.S. Patent Application No. 61/846,931, entitled "Label Printer," filed Jul. 16, 2013, the disclosures of which are incorporated by reference herein in their entirety.

BACKGROUND OF THE DISCLOSURE

1. Field of the Disclosure

The embodiments disclosed herein relate to label printers, and in particular to cartridges for dispensing labels in a label printer.

2. Description of the Related Art

There are a myriad of applications where it is desirable to efficiently, routinely and inexpensively label items. For example, in a medical setting, personnel print labels on a daily basis for new medical records and for updating old medical records. Without providing additional examples, it suffices to note that there is an enormous demand for quality labeling systems.

Accordingly, a number of specialized label printers have been developed and are commercially available. Generally, such label printers are efficient and reliable but not without expense. For example, many of these label printers make use of expensive cartridges for containing and dispensing labels.

More specifically, and by way of example, typical label cartridges include a label supply that is disposed within a hard plastic disposable housing. Clearly, such label cartridges are substantially more robust than needed for simply dispensing a small supply of labels. Not only does this cost a customer more than is necessary, but such technology is also expensive when considering shipping, warehousing and disposal.

Thus, what are needed are methods and apparatus to provide improved cartridges for a label printer. Preferably, the cartridges provide for reliable printing of labels, are inexpensive to manufacture and distribute, and offer a reduced environmental impact over the prior art.

SUMMARY OF THE DISCLOSURE

In one embodiment, a cartridge body for a cartridge for providing media to a printer includes a first part and a complimentary second part, the first part and the second part formed of post-consumer-material; a hinge integrally connected to the first part and the second part and adapted to close the first part and the second part together over the media and contain the media therein; and an opening formed by the closed first part and second part for dispensing the media to the printer.

In another embodiment, a cartridge for dispensing media to a printer is provided. The cartridge includes a body that includes a first part and a complimentary second part, the first part and the second part formed of post-consumer-material; a hinge integrally connected to the first part and the second part and adapted to close the first part and the second part together over the media and contain the media therein; and an opening formed by the closed first part and second part for dispensing the media to the printer and a media guide disposed over the opening.

In another embodiment, a method for fabricating a cartridge for dispensing media to a printer, is provided. The method includes selecting a unitary body including two parts, each part joined to the other by a hinge therebetween, each part of the body including a dimple for retaining a roll of media and configured to close together over the media and provide an opening for hosting a dispenser adapted for dispensing the media to the printer; disposing the roll of media in one part; closing the two over the media; and, disposing the dispenser over the opening.

In yet another embodiment, a method for fabricating a body for a cartridge for dispensing media to a printer is provided. The method includes selecting material for molding the body; and, molding a unitary body including two parts, each part joinable to the other by a hinge therebetween, each part of the body comprising a dimple for retaining a roll of media and configured to close together over the media and provide an opening for hosting a dispenser adapted for dispensing the media to the printer.

BRIEF DESCRIPTION OF THE DRAWINGS

The features and advantages of the disclosed embodiments are apparent from the following description taken in conjunction with the accompanying drawings in which.

DETAILED DESCRIPTION

Disclosed herein are methods and apparatus for providing a cartridge for a printer. In the exemplary embodiments, the printer is a label printer. Advantageously, construction of the label cartridge uses a small amount of materials, and may be fabricated from substantially recyclable materials. As a result, the label cartridge provided is a low-cost, environmentally friendly device.

Figure 1:
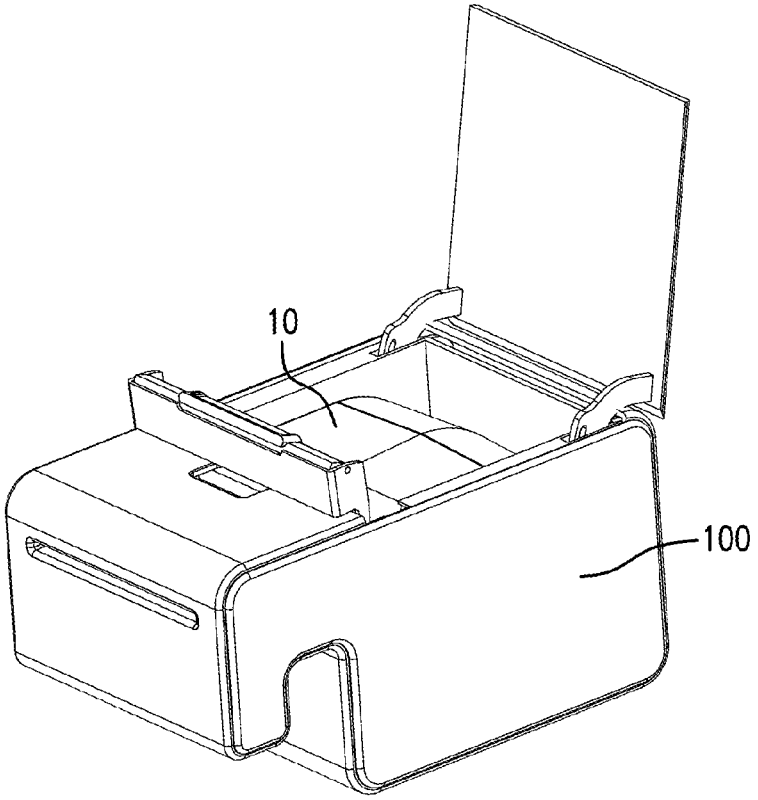
FIG. 1 is an isometric view of an exemplary label printer.

Referring now to FIG. 1, there is shown an exemplary label printer 100. The label printer 100 may be used to print labels having a wide range of characteristics. For example, the label printer 100 may print labels having a variety of substrate materials (e.g., labels may be formed of paper, plastic, film, foil, any other substrate material deemed appropriate and may be provided as combinations of the foregoing). The label printer may print labels having a variety of sizes (e.g., such as any size from a variety of standard sizes used in office work, and may include specialty sizes for custom applications).

The label printer 100 may be deployed as a desktop printer (as shown). However, in some embodiments, the label printer 100 is a hand-held unit. Generally, the label printer 100 includes at least one form of user interface (not shown). Exemplary user interfaces include at least one keypad and/or display on the label printer 100, and may further include a network interface, a local interface (e.g., USB, serial, parallel, wireless and the like). In short, the label printer 100 may be provided as a printer having a diverse set of printing capabilities for printing media provided as a roll of stock and dispensed from a cartridge. Disposed within the label printer 100 is a cartridge 10.

Figure 2:
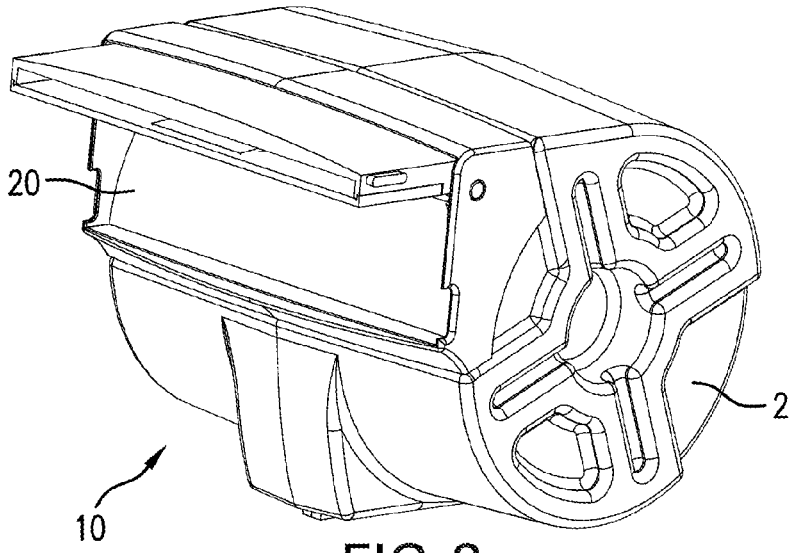
FIG. 2 is an isometric view of an exemplary cartridge that includes a body and a dispenser, the cartridge for providing printer labels to the label printer of FIG. 1.

Referring to FIG. 2, an exemplary embodiment of the cartridge 10 is shown. In this example, the cartridge 10 includes a body 2 and a media guide 20. Disposed within the body 2 is a roll of labels (also referred to as a "spool of labels"). The roll of labels may be pulled from the cartridge 10 through the media guide 20 by the label printer 100 as needed. Techniques for feeding labels from the cartridge 10 are known in the art, and therefore discussed herein only on a limited basis.

Figure 3:
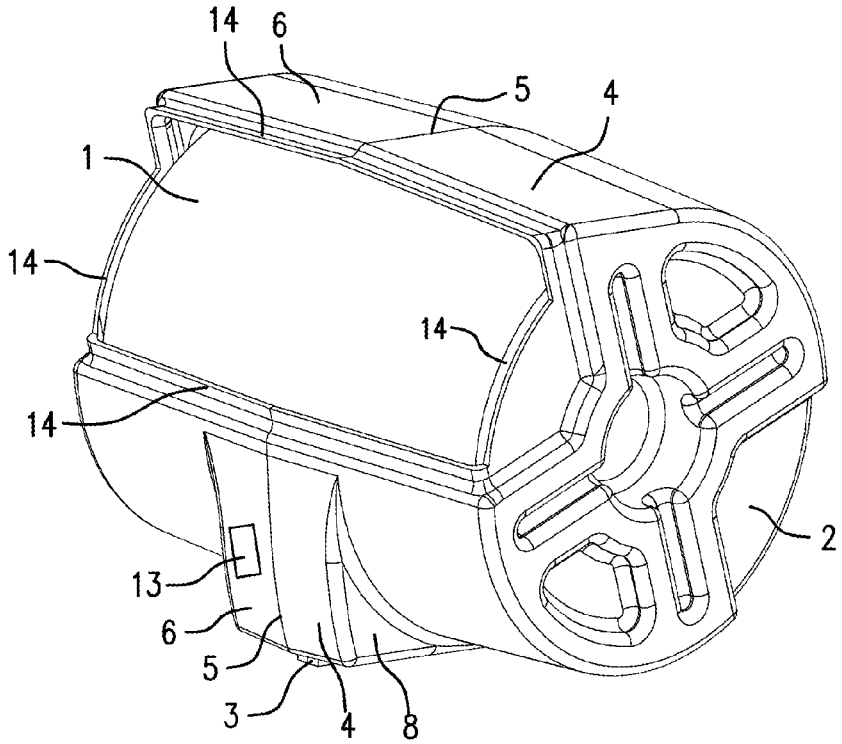
FIG. 3 is an isometric view of a body of the cartridge of FIG. 2 with labels disposed therein.

Referring now to FIG. 3, a view of the body 2 (i.e., the cartridge 10 without the media guide 20) is shown. In this example, a full roll of labels 1 is visible, and occupies an interior portion of the body 2. Generally, the body 2 is formed of a unitary piece of material (note that assembly of the body 2 is discussed further herein).

In its assembled form, the body 2 has a first part 4 that is mated to a second part 6 at a seam 5. The combination of the first part 4 and the second part 6 results in an opening for hosting the media guide 20. The opening is defined by a mounting lip 14. The mounting lip 14 generally includes attributes that are suited for joining together with a backside of the media guide 20. In one embodiment, the media guide 20 includes dimples configured for least one of hooking and clamping onto material of the mounting lip 14. Accordingly, mounting of the media guide 20 to the mounting lip 14 may be accomplished without the aid of glue, tape, or other adhesives (although adhesives may be used, if desired).

In this example, the body 2 includes an alignment feature such as a keel 8 disposed at a base of the body 2. The keel 8 generally provides for stability and a secure fit of the cartridge 10 when the cartridge 10 is disposed within the label printer 100. That is, in some embodiments, each printer 100 may make use of a plurality of differently sized cartridges 10. Each of the differently sized cartridges 10 may include a commonly sized keel 8. Accordingly, although a single printer 100 may be configured for using cartridges of varying size, each cartridge 10 that is loaded into the printer 100 will be installed in an appropriate geometry (such as centrally aligned) within the printer 100.

In some embodiments, the alignment feature is separate from the keel 8. For example, the alignment feature may include a feature disposed along a top of the cartridge 10.

Generally, the body 2 is formed from recyclable material such as paper pulp. The material may include at least one of natural fibers and synthetic fibers and it may further include at least one of natural and synthetic binders as deemed appropriate. The binders may be included for various purposes. For example, binders may be selected to at least one of provide physical strength, resistance to humidity and/or moisture, to enhance marking of the body 2 and for other similar purposes. The material may be at least one of laminated, layered, coated, and treated as deemed appropriate. The material(s) used may be biodegradable, or at least partially biodegradable.

In this example, a body hinge 3 is provided in a central portion of the body 2 that exists between the first part 4 and the second part 6.

Generally, the cartridge 10 includes the first part 4 and the second part 6. In the exemplary embodiment, the first part 4 and the second part 6 provide for a "clam-shell" style of device, where the two sides close upon each other. However, this is merely illustrative and is not limiting of the teachings herein. That is, it may be considered that, in some embodiments, the first part 4 and the second part 6 are simply joined together to result in the body 2. In some embodiments, the first part 4 and the second part 6 are a bottom and a top, respectively, and are not respective sides.

Figure 4:
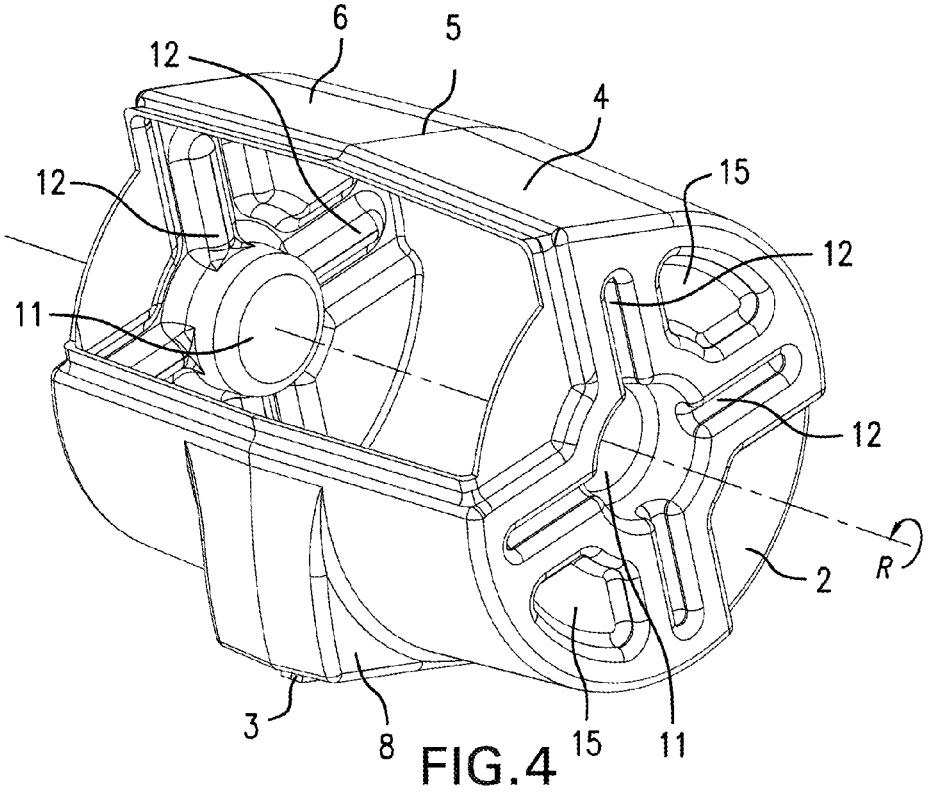
FIG. 4 is an isometric view of the body depicted in FIG. 3, without labels disposed therein.

Refer now also to FIG. 4 where a view of the body 2 in its empty form is provided. In this depiction, it may be seen that there is a respective inward dimple 11 disposed in a center of each of the first part 4 and the second part 6. Collectively, the pair of dimples 11 provides a mounting feature for mounting and retaining the roll of labels 1. Extending radially outward from each of the dimples 11 is a plurality of ribs 12. Each of the ribs 12 enhances strength of a sidewall of each of the first part 4 and the second part 6, and further helps to ensure alignment of the roll of labels 1 as it rotates about an axis of rotation, R. In some embodiments, a plurality of guides 15 may also be included. Similarly, each of the guides 15 enhances strength of a respective sidewall, and further helps to ensure alignment of the roll of labels 1 as it rotates about the axis of rotation, R.

In some embodiments, a support is provided in place of or in addition to the dimple 11. As one example, the support may include a solid portion of material (similar to the dimple 11), a perforation through which an axle is disposed, or another type of support. That is, the body 2 may include a support that provides a mounting feature for mounting and retaining the roll of labels 1, and the support is not limited to being a dimple 11.

Figure 5:
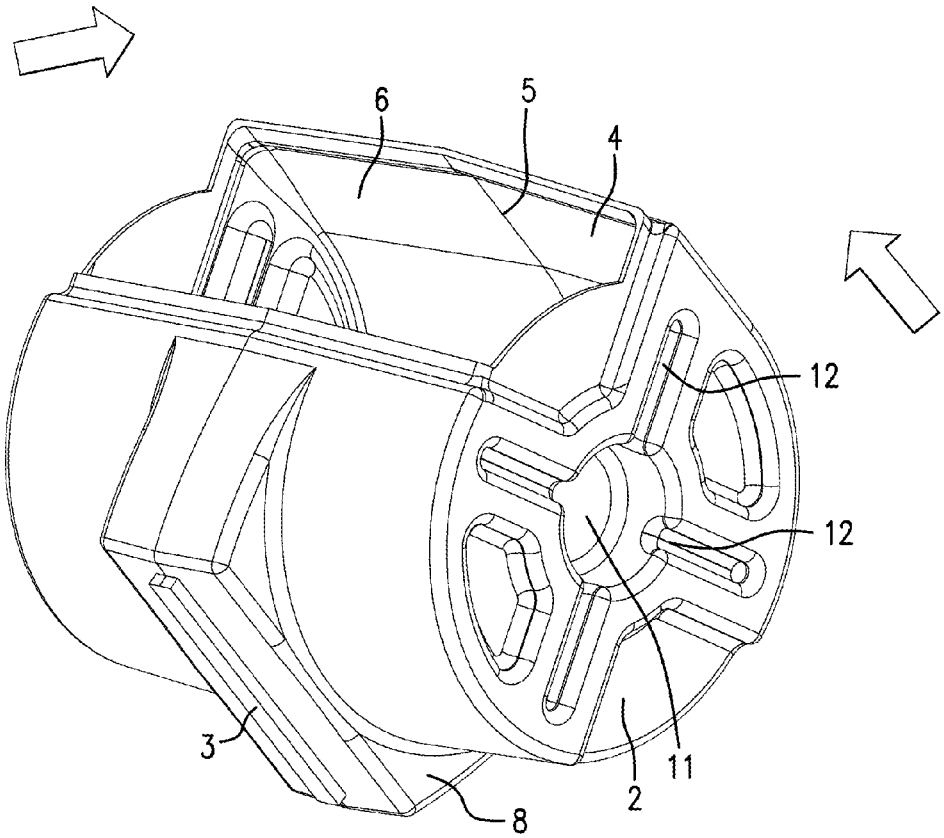
FIG. 5 is an isometric view of that includes a portion of the underside of the body depicted in FIG. 4.

Referring now to FIG. 5, another perspective view of the body 2 is shown. In this illustration, and underside of the body 2 is more clearly depicted. It may be seen that the keel 8 provides for a substantial surface for seating the cartridge 10 within the label printer 100. It may also be seen that the body hinge 3 includes a continuous portion of material that extends (or is shared with) the first part 4 and the second part 6.

When initially fabricated, the body 2 may be seen as two side-by-side cups (embodiment not shown). A first cup correlates to the first part 4 of the body 2 and a second cup correlates to the second part 6 of the body 2. Connecting the two side-by-side cups is the continuous portion of material that extends (or is shared with) the first part 4 and the second part 6 and referred to herein as the body hinge 3.

Note that opposing arrows are shown above the body 2. The opposing arrows are provided to imply folding together of the two side-by-side cups to provide the body 2. Prior to the folding, the roll of labels 1 may be loaded into one of the two side-by-side cups (i.e., one side of the first part 4 and the second part 6). Once the two side-by-side cups are folded together to provide the body 2 having the first part 4 and the second part 6, the seam 5 may be secured. The seam 5 may be secured with tape, glue, ultrasonic welding or by any other type of security deemed appropriate. For example, in some embodiments, interlocking features (e.g., lugs and openings, etc.) may be provided in each of the first part 4 and the second part 6, such that when the body 2 folded together, the first part 4 and the second part 6 naturally interlock.

Figure 6:
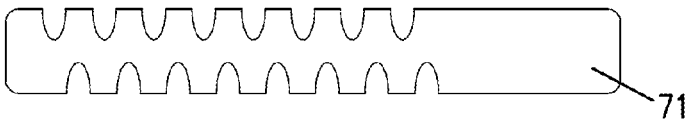
FIGS. 6 and 7 depict embodiments of tape for taping portions of the body together.
Figure 7:
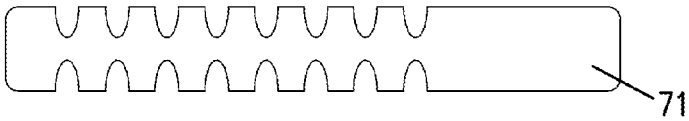

In some embodiments, the first part 4 and the second part 6 are held together, at least in part, by tape disposed over the seam 5. In some embodiments, the tape is a patterned tape. That is, the tape may be designed to avoid bunching or wrinkling by incorporation of a pattern therein. Reference may be had to FIGS. 6 and 7. In FIGS. 6 and 7, embodiments of patterned tape 71 are shown. In FIG. 6, the tape 71 includes an "alternating pattern." In FIG. 7, the tape 71 includes a "waffle pattern."

Figure 8:
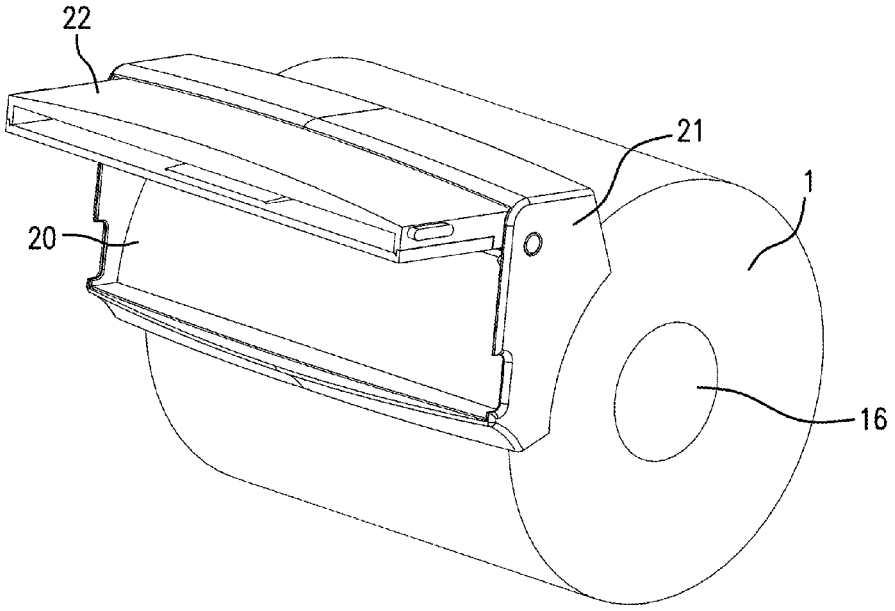
FIG. 8 is an isometric view of a front side of a dispenser positioned relative to a label roll, wherein the body has been omitted from this view.

In some embodiments, the body 2 is held together simply by mounting of the media guide 20 onto the body 2. Additionally, by providing a secure fit within the label printer 100, it may be assured that the cartridge 10 is maintained in a unitary form. Refer now to FIG. 8 where aspects of the media guide 20 are shown in greater detail.

In FIG. 8, the media guide 20 is shown in relation to the roll of labels 1 without the body 2 (merely for purposes of illustration and a better understanding of the media guide 20). The media guide 20 includes a frame 21 and a feeder 22. The feeder 22 receives label stock from the roll of labels 1 and feeds the label stock to the label printer 100. The roll of labels 1 includes an inner annulus 16. The inner annulus 16 exhibits a diameter that is suited for securely mating with the pair of dimples 11 disposed in the body 2. Accordingly, in some embodiments, the roll of labels 1 does not require an inner support or axle, such as a cardboard tube, and is thus more cost-effective to produce. In some other embodiments, the roll of labels 1 is loaded onto spool.

In some embodiments, the media guide 20 may be referred to as a "dispenser" and by other similar terms.

The cartridge 10 may include an electronic component, simply referred to as a "chip" 13 (see FIG. 3). The chip 13 may include, for example, a radiofrequency identification antenna (RFID), non-volatile random-access-memory (NVRAM), other similar components as well as suitable combinations thereof. Generally, the chip 13 includes memory to provide for tracking of information, assessment and/or control of functionality and the like. Accordingly, the printer 100 may be configured to recognize each cartridge 10. Once recognition has been performed, the printer 100 may adjust internal parameters, communicate recognition information, and perform other similar functions. In some embodiments, the printer 100 is configured to store data in the chip 13. Data stored may include information such as a number of remaining labels within the cartridge 10. In short, the chip 13 is generally configured for exchanging information with the printer 100 regarding the media.

In some embodiments, the chip 13 is disposed on the body 2. In some other embodiments, the chip 13 is disposed on the media guide 20. Generally, the chip 13 may be oriented such that when the cartridge 10 is loaded into the printer 100, the printer 100 may reliably interface with the chip 13. For example, the chip 13 may be oriented such that contacts on the chip 13 align with contacts on the printer 100 when the cartridge 10 is installed. In one embodiment, the chip 13 is centrally oriented on the media guide 20, such as on the frame 21 above the keel 8.

In some embodiments, the chip 13 includes encryption technologies. For example, at least some of the contents of the chip 13 may be stored and/or communicated in encrypted form. Accordingly, the printer 100 may also include encryption capabilities for communication with the chip 13.

Figure 9:
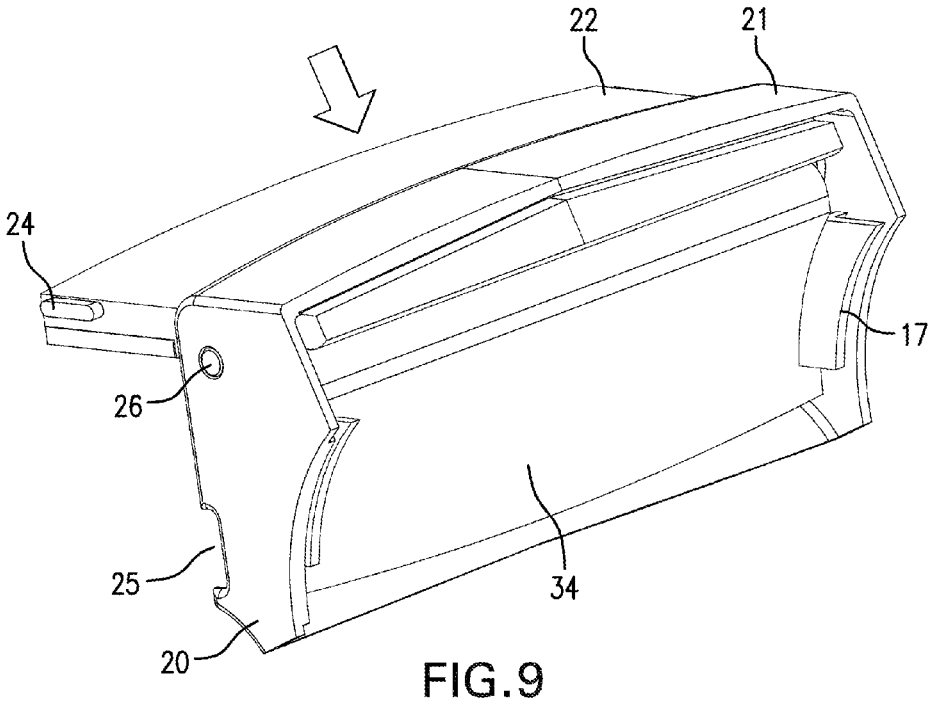
FIG. 9 is an isometric view of a backside of the dispenser of FIG. 8.

Referring now to FIG. 9, a back side of the media guide 20 is shown. In this embodiment, the feeder 22 is rotatably coupled to the frame 21 at a dispenser hinge 26. The dispenser hinge 26 is disposed on each side of the frame 21. As may be seen in this view, the frame 21 may include at least one mount 17. The mount 17 provides for retention of the frame 21 on the mounting lip 14 of the body 2. The mount 17 may be provided in any form deemed suitable for mating with the body 2. Generally, the frame 21 includes a face 34 that extends from one sidewall to an opposing sidewall. The face 34 provides for substantial mechanical strength in the frame 21, and may additionally prevent inadvertent damage to the roll of labels 1. When the cartridge 10 is installed in the label printer 100, the feeder 22 may be oriented in an upward position (as shown). However, prior to use, a size of the cartridge 10 may be minimized by rotating the feeder 22 into a downward position (not shown, as implied by the downward pointing arrow). When the feeder 22 is in a downward position, finger grips 24 disposed on each side of the feeder 22 aligns with and is received by a respective grip receiver 25 disposed within the frame 21. The finger grips 24 may snap into the respective grip receivers 25, or may simply align there with. In either case, the finger grips 24 respective grip receivers 25 provide for increased strength of the media guide 20 when the cartridge 10 is not in use.

Figure 10:
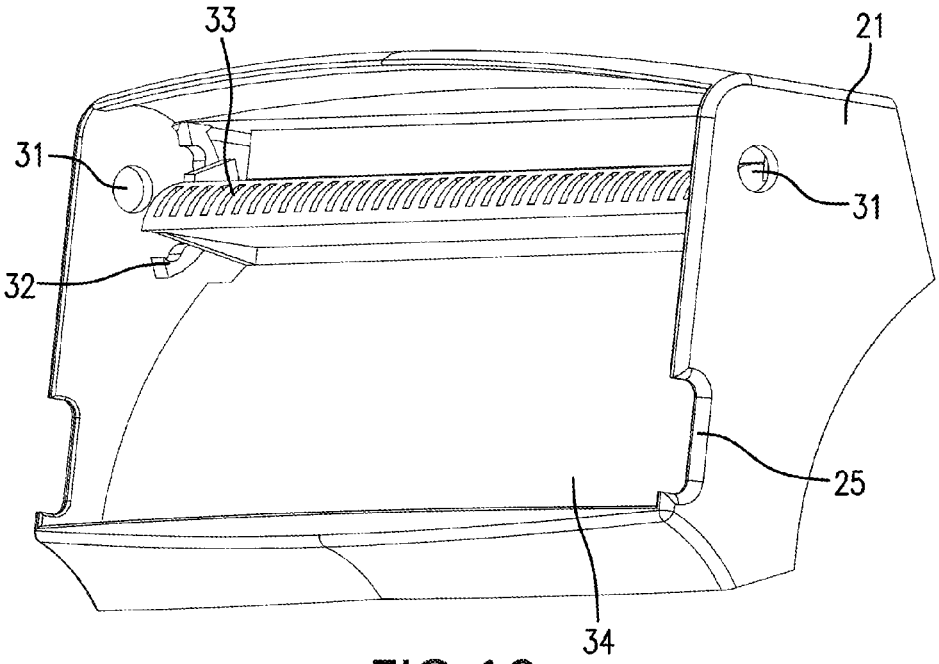
FIG. 10 is an isometric view of a front side of a frame for the dispenser of FIGS. 8 and 9.

Referring now to FIG. 10, a front side of the frame 21 is shown. In this illustration, the feeder 22 has been removed to better present and discuss features of the frame 21. In particular, it may be seen that the frame 21 includes opposing thruways 31. The thruways 31 provide for retention of respective pins to provide for each dispenser hinge 26. Complementing each thruway 31 is a semicircular guide rail 32 which is provided to cooperate with a positioning guide of the feeder 22. Each guide rail 32 may include a stop (not shown) for cooperating with a stop of each respective positioning guide, and therefore restricting movement of the feeder 22. The frame 21 may include at least one cross member 33. The at least one cross member may be positions to provide for enhanced strength of the frame 21 and the feeder 22.

In some embodiments, the face 34 is a solid surface. In some other embodiments, the face includes a window (which may be open). The window may be provided for users to monitor label stock, and may further be designed to reduce usage of materials in construction of the media guide 20.

Figure 11:
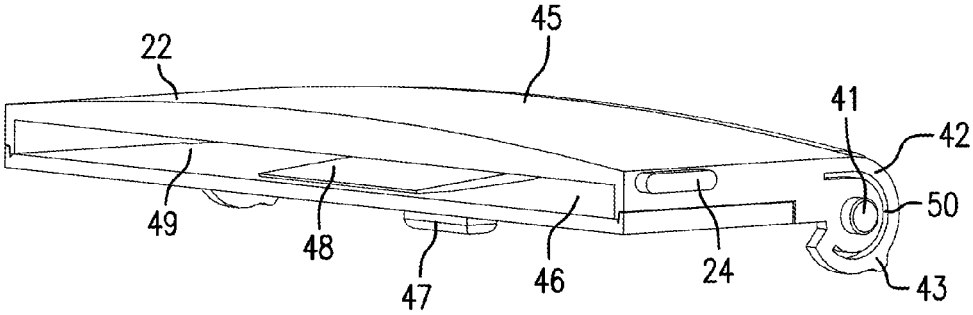
FIG. 11 is an isometric view of a feeder for the dispenser of FIGS. 8 and 9.

Referring now to FIG. 11, an embodiment of the feeder 22 is depicted. In this example, the feeder 22 is depicted separately from the frame 21 and the body 2 to better present and discuss features of the feeder 22. In this example, the feeder 22 includes a pair of pins 41 (one pin 41 being shown). Each pin 41 is inserted into a respective one of the thruways 31 of the frame 21. Collectively, each pin 41 and thruway 31 provides for a dispenser hinge 26. Also shown, is one of two positioning guides 42. Generally, each positioning guide 42 is provided to cooperate with a respective one of the guide rails 32 on the frame 21. As shown in FIG. 9, each positioning guide 42 may include at least one stop 43. The at least one stop 43 may provide for restricting or controlling movement of the feeder 22. A channel 50 may be included with the positioning guide 42. The channel 50 may be provided to provide some degree of spring, flexibility and/or resilience in the rotation motion of the feeder 22. The channel 50 may further aid installation of the pin 41 into the respective thruway 31 by enhancing flexibility of the feeder 22.

In this example, the feeder 22 is formed of two pieces of material. The material may be plastic, metal, a composite material or any other material deemed suitable. A feeder top 45 includes the pins 41 and the alignment tabs 24. A feeder bottom 46 is mated to the feeder top 45 and results in a throat 49 which defines an exit for the media. During use, the label stock is fed through the throat 49 and to the label printer 100. Included as a part of the feeder top 45 and within the throat 49 is a leaf spring 48. Generally, the leaf spring 48 may be anchored at one end. Incorporation of the leaf spring 48 provides for retention of the label stock, as well as smooth feeding of the label stock and generally prevents the label stock from sliding backward towards the roll. Accordingly, the feeder top 45 may be fabricated separately from the feeder bottom 46 to ensure the leaf spring 48 imparts adequate pressure. Generally, the feeder bottom 46 is mated to the feeder top 45 along sidewalls thereof, such as below the alignment tabs 24. The feeder bottom 46 may be mated to the feeder top 45 by use of at least one of interlocking features, glue and other similar techniques. An optional alignment rib 47 may be included on an exterior of the feeder bottom 46. The alignment rib 47 may be provided to enhance physical strength of the feeder 22 when the feeder 22 is in a closed position and overlying the face 34 of the frame 21 and to ensure alignment.

Additionally, when closed, the feeder 22 may redirect the media downwards over the semicircular guide rail, adding some force to help prevent the label end from slipping back into the enclosing cartridge 10. For a completely closed, disposable cartridge, having the end get wound inside would render it useless (much like winding a 35 mm film canister so the leader goes inside).

The feeder 22 may optionally include restrictive guides (for example, a spacer as described below) either molded in or slipped into the throat 49. These restrictive guides narrow the opening from side to side and allow a single cartridge to be used for narrower media rolls. The narrower media may be wound on a cardboard or other core that is the full cartridge width in order to engage with the dimples in the paper pulp. To prevent such a roll from "telescoping" inside the cartridge, cardboard or other forms of washers of an appropriate thickness can be slid over the core to prevent side to side movement of the narrower roll in the cartridge. These washers, in effect, reduce the internal paper path to match that of the throat-narrowing guides (refer to discussion regarding FIG. 12 below).

Generally, the media guide 20 is fabricated from a robust material such as an appropriate form of plastic or polymer. The feeder 22 and the frame 21 may be fabricated from similar materials, or may incorporate different materials. In some embodiments, at least one of the frame 21 in the feeder 22 include metallic components.

Generally, fabrication of the cartridge 10 begins with fabrication of the body 2. Fabrication of the body 2 may be performed by molding material for the body 2. Once the body 2 has been formed, one side is loaded with label stock. Subsequently, the other side of the body 2 is folded over the label stock and the two parts of the body 2 are joined together at the seam 5. Optionally, fabrication may include applying the media guide 20 to the body 2. Applying the media guide 20 to the body 2 may be delayed. For example, application of the media guide 20 to the body 2 may be performed by an end-user.

Figure 12:
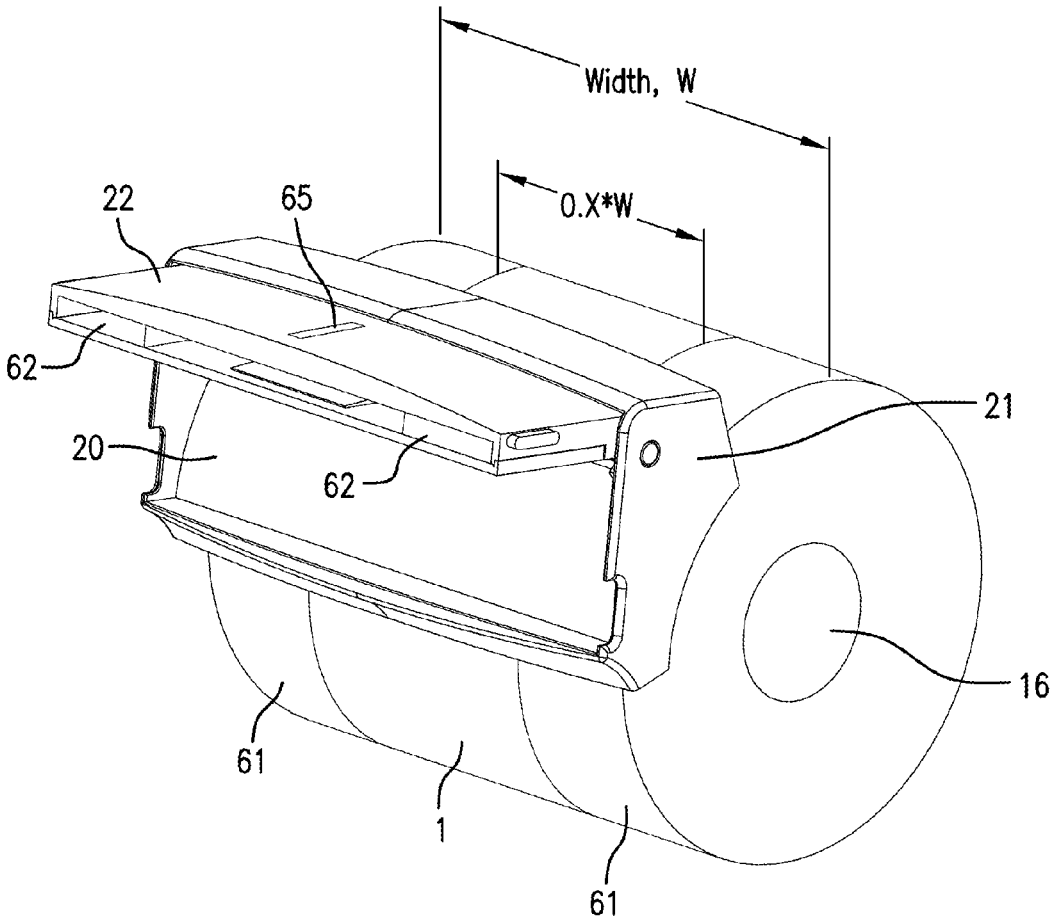
FIG. 12 is an isometric view of the dispenser and the label roll, further depicting washers and spacers for printing odd sized media; and, FIGS. 13-15 are depictions of the cartridge disposed in a display card.

Referring now also to FIG. 12, it may be seen that the feeder 22 and the roll of labels 1 are generally of a width, W (see FIG. 7). Generally, the width, W, of the feeder 22 is suited for dispensing labels 1 of a similarly sized width, W. In some embodiments, the feeder 22 may be provided with at least one spacer 62. The spacers 62 may be disposed within the feeder 22 (for example, in the throat 49), and provide for alignment of the labels 1 that have a lesser width, (0.X*W). Similarly, the roll of labels 1 may be complimented with at least one washer 61. The washers 61 provide for alignment of the labels 1 that have a lesser width, (0.X*W). In some embodiments, only one spacer 62 and one washer 61 are used within the cartridge 10.

Accordingly, each embodiment of the feeder 22 may be configured to feed labels 1 of a variety of widths (from a full width, W, to smaller fractions of the full width, W).

In embodiments where the roll of labels 1 has a lesser width, W, additional alignment features may be employed. For example, a washer (not shown) may be added to each side of the roll of labels 1, effectively increasing the width of the roll of labels 1 to a full width, W.

The washers 61 and the spacers 62 may be fabricated from any type of material deemed appropriate.

In some embodiments, at least one washer 61 is either complimented by or replaced by an extended dimple 11. That is, in some embodiments, a geometry of the dimple 11 may be adjusted to accommodate the roll of labels 1 having a reduced width (0.X*W).

In some embodiments, the feeder 22 further includes a slot 65. The slot 65 may be included to mate with a portion of the printer 100, thereby assuring alignment. The feeder 22 may include other alignment features to aid in orientation of the cartridge 10 within the printer 100. The finger grips 24 may also be used to assist with alignment when the cartridge 10 is disposed into the printer 100.

Figure 13:
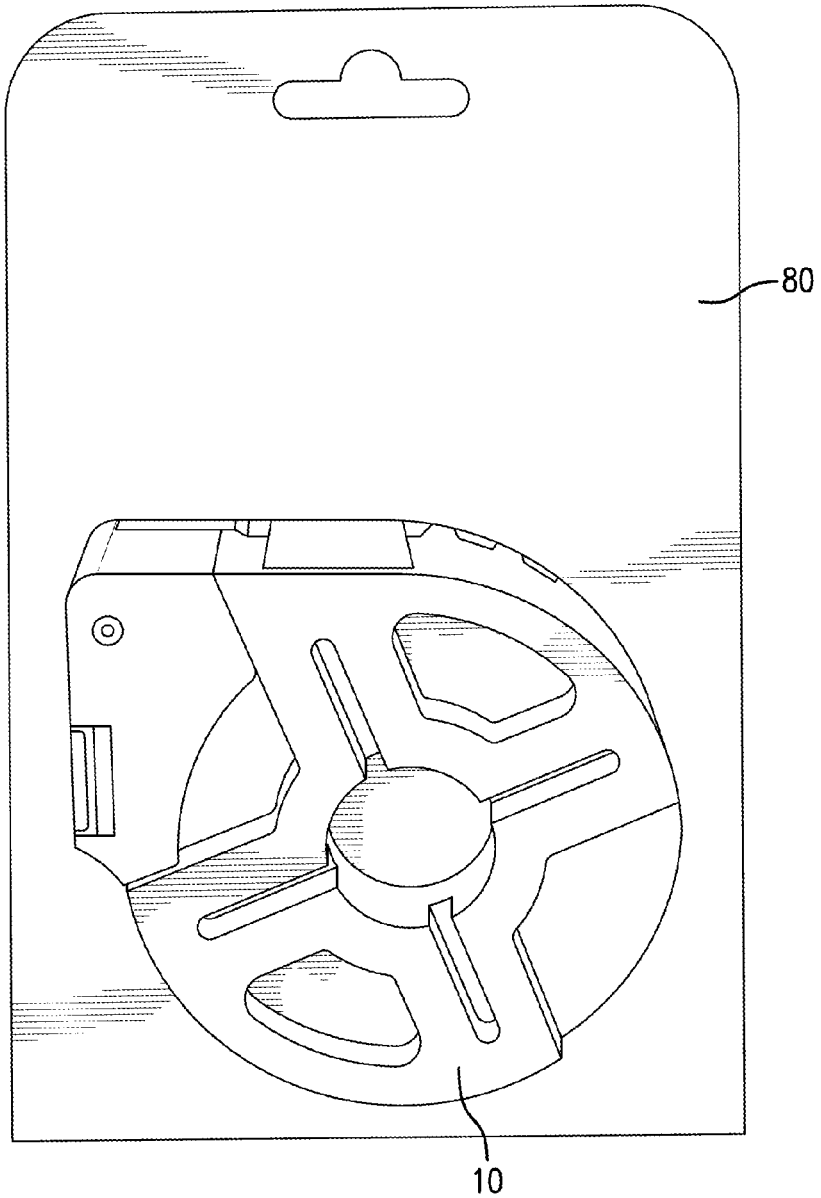
Figure 14:
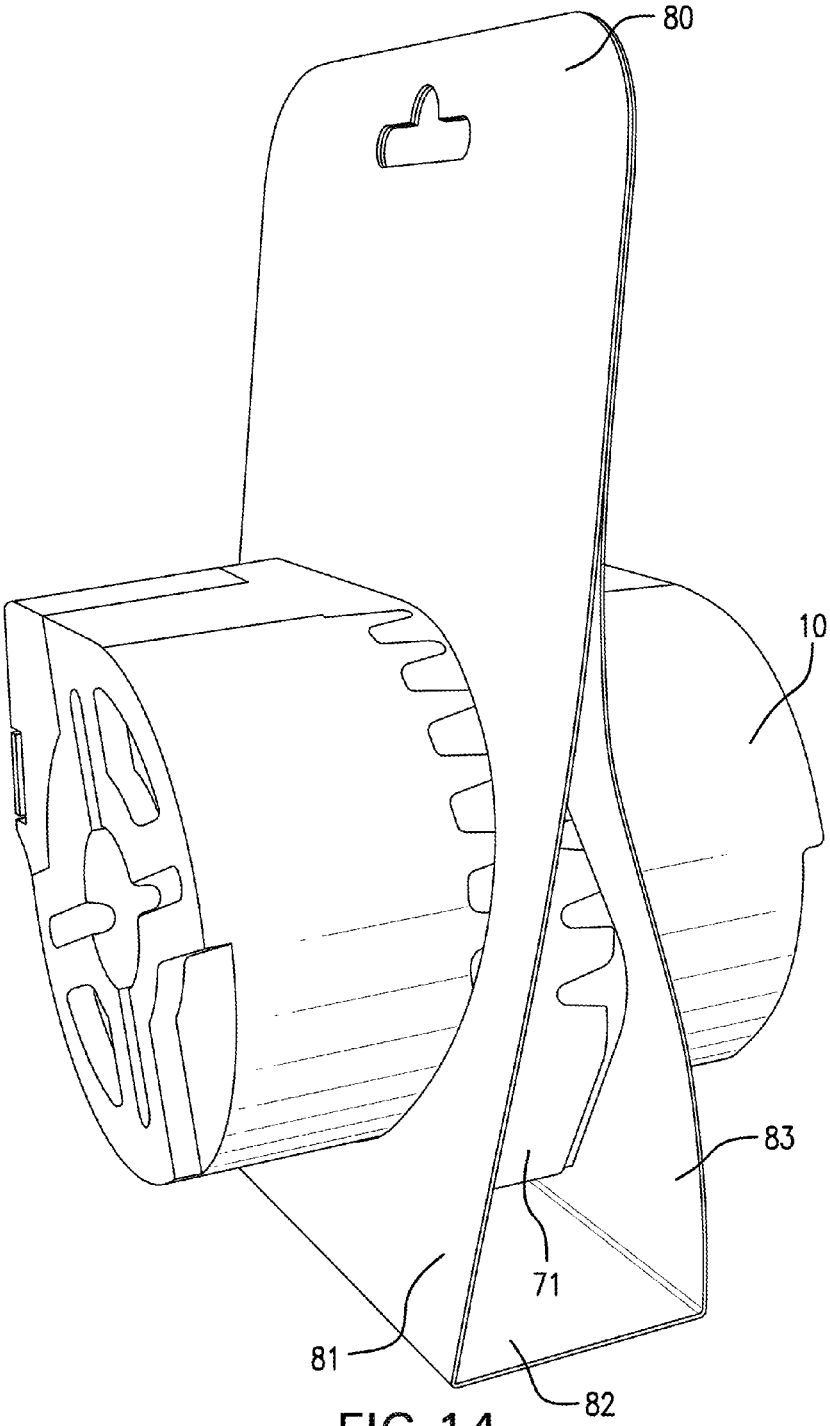
Figure 15:
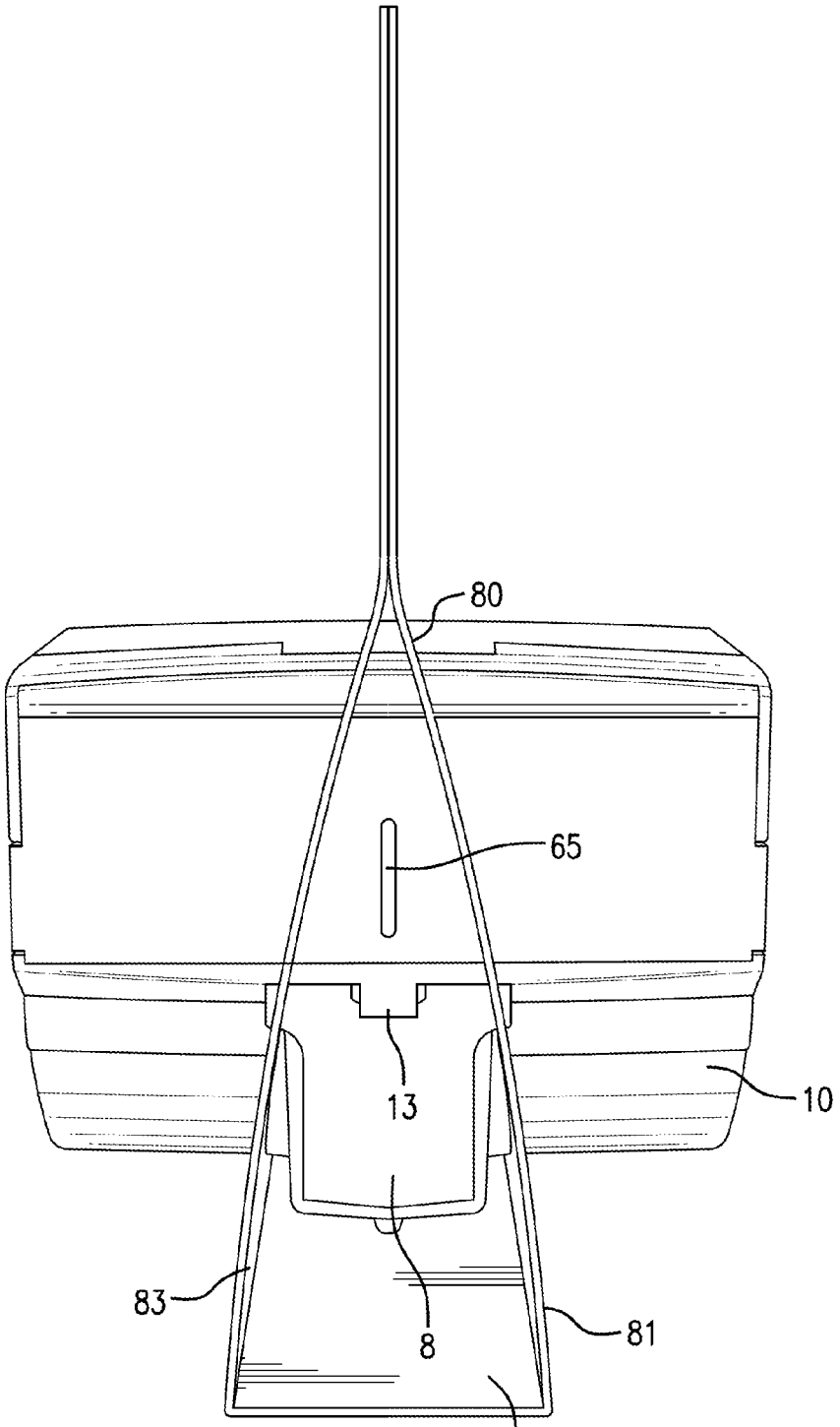

As shown in FIGS. 13-15, the cartridge 10 may be displayed in a display card 80. Generally, the display card 80 may be provided as a display device that is fabricated from recyclable materials such as card stock. Advantageously, this avoids the cost and annoyance of blister packaging. In the embodiments shown, the display card 80 provides for use in hanging displays as well as shelf display.

Generally, the display card 80 includes a front 81, a base 82 and a back 83. The display card 80 includes a cutout that has a profile of the body 2 of the cartridge 10. A user assembling units for display, such as for retail, may take a quantity of display cards 80 and insert appropriately sized cartridges 10 into respective cutouts. In some embodiments, a width of the base 82 is just slightly larger than a width of the keel 8. Accordingly, once placed through the cutout, the cartridge 10 remains secure within the display card 80.

Also shown in FIGS. 14-15 are the slot 65, the tape 71 and a location for the chip 13.

Having discussed an exemplary embodiment of the cartridge 10, aspects of additional embodiments and features are now presented.

By virtue of a separate media guide 20 and body 2, it is possible to provide substantially decrease manufacturing costs. For example, the media guide 20 may be manufactured with greater respect for fitment and tolerances associated with fitting the cartridge 10 into the label printer 100. However, the body 2 may be manufactured with much greater latitude in sizing and conformity with specifications.

Advantageously, the media guide 20 may be easily separated from the body 2. Accordingly, in some embodiments, the media guide 20 is provided as a reusable and replaceable component. In some of these embodiments, a manufacturer may provide users with new media guides 20 for bodies 2 to replace broken or non-functional media guides. Beneficially, this provides for an ability to use remaining media stock even in the event of a failure of the media guide.

The body 2 may include other adornments or features. For example, the body may include reinforcing structures (i.e., reinforcements) for particularly large implementations. Reinforcements may include, for example, at least one of additional features incorporated into the material used to form the body 2 and may include other components such as metallic strips disposed within or attached to the body 2, as well as other similar implementations.

The cartridge 10 may include adornments such as handles, gripping tabs and the like to aid in handling of the cartridge 10. For example, the cartridge 10 may include a pull-tab (not shown) to simplify removal of the cartridge 10 from the label printer 100. The pull-tab may include, for example, a piece of tape affixed to the body 2. The pull-tab may include at least one of woven, non-woven, spun, and braided material. In some embodiments of the prior art, the pull tab for a larger cartridge will fill up the cartridge bay in the printer and does not leave any space for finger recesses to remove the cartridge from the printer. Advantageously, the pull-tab on the cartridge (which may be combined with a product identification label) solves this problem, thus resulting in a more compact printer.

The cartridge 10 may be configured for particular embodiments of label printers 100. In some embodiments, the cartridge 10 is configured for use in prior art label printers 100. Advantageously, techniques for fabrication of the cartridge provide for use in a wide variety of label printers 100. Further, manufacturers of the cartridge 10 may quickly adapt manufacturing techniques to accommodate changing specifications for label printers 100.

Various other components may be included and called upon for providing for aspects of the teachings herein. For example, additional materials, combinations of materials and/or omission of materials may be used to provide for added embodiments that are within the scope of the teachings herein.

When introducing elements of the presently disclosed embodiments, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

While the disclosure has been provided with reference to exemplary embodiments, it will be understood by those skilled in the art that various changes may be made and equivalents may be substituted for elements thereof without departing from the scope of the disclosure. In addition, many modifications will be appreciated by those skilled in the art to adapt a particular instrument, situation or material to the teachings of the disclosure without departing from the essential scope thereof. Therefore, it is intended that the disclosure not be limited to the particular embodiments disclosed.

What is claimed is:

1. A cartridge body for a cartridge for providing media to a printer, the body comprising:

a first part and a complementary second part, the first part and the second part formed of post-consumer-material;

a hinge integrally connected to the first part and the second part and adapted to close the first part and the second part together over the media along a hinge axis and a seam generally defining a plane and contain the media therein, the media comprising a rotational axis generally perpendicular to the plane; and an opening formed by the closed first part and second part for dispensing the media to the printer.

2. The cartridge body as in claim 1, wherein the first part and the second part comprise respective cup-shaped parts.

3. The cartridge body as in claim 1, further comprising an alignment feature formed in the body.

4. The cartridge body as in claim 3, wherein the alignment feature comprises a keel disposed in the body.

5. The cartridge body as in claim 1, wherein the post-consumer-material comprises at least one of paper pulp, natural fibers, synthetic fibers, a synthetic binder and a natural binder.

6. The cartridge body as in claim 1, wherein at least a portion of the opening comprises a mounting lip for receiving a media guide when the body is in a closed configuration.

7. The cartridge body as in claim 1, wherein the mounting lip is adapted for receiving the media guide without the aid of glue, tape or adhesive.

8. The cartridge body as in claim 1, wherein at least one of the parts comprises a support for supporting the media.

9. The cartridge body as in claim 8, wherein the support comprises a dimple.

10. The cartridge body as in claim 1, wherein the hinge is formed of the post-consumer-material.

11. A cartridge for providing media to a printer, the cartridge comprising:

a body including a first part and a second part, the first part and the second part adapted to close together over the media and contain the media therein, and an opening formed by the closed first part and second part; and a media guide disposed over the opening and configured for dispensing the media to the printer, wherein the media guide comprises a feeder and a frame, the feeder coupled to the frame and rotatable between an open position for dispensing the media to the printer and a closed position to reduce a size of the cartridge.

12. The cartridge as in claim 11, further comprising a patterned tape disposed over at least a portion of a seam where the first part and the second part are closed together.

13. The cartridge as in claim 12, wherein the tape comprises one of an alternating pattern and a waffle pattern.

14. The cartridge as in claim 11, where, the feeder is configured to securely retain the media when rotated to the closed position.

15. The cartridge as in claim 11, wherein the frame comprises at least one mount configured for mounting to the opening.

16. The cartridge as in claim 11, wherein the feeder comprises a throat configured for dispensing the media.

17. The cartridge as in claim 16, further comprising a leaf spring disposed in the throat, the leaf spring configured for retention of the media.

18. The cartridge as in claim 11, wherein the feeder comprises at least one spacer to accommodate narrow media.

19. The cartridge as in claim 11, further comprising a spool of media disposed therein.

20. The cartridge as in claim 19, wherein a width of the spool of media is substantially the width of the body when the body is in a closed configuration.

21. The cartridge as in claim 19, wherein the spool of media is wound on a core that is substantially the width of the body when the body is in a closed configuration.

22. The cartridge as in claim 21, further comprising at least one washer disposed on the core.

23. The cartridge as in claim 11, further comprising a chip configured for communicating with the printer disposed thereon, the chip comprising at least one of non-volatile random-access-memory (NVRAM) and a radio-frequency identification (RFID) antenna.

24. The cartridge as in claim 23, wherein the chip is configured for at least one of encrypted communications and encrypted data storage.

25. The cartridge as in claim 23, wherein the chip stores information regarding the media.

26. The cartridge as in claim 23, wherein the chip is affixed to one of: the frame, the body and the feeder.

27. The cartridge as in claim 11, wherein the body is configured to be disposed within a display card.

28. The cartridge as in claim 11, wherein the media guide is removably disposed over the opening.

29. The cartridge as in claim 11, wherein the media guide comprises a slot disposed on a first surface of the media guide, the slot configured to mate with a corresponding portion of the printer to align the cartridge within the printer.

30. The cartridge as in claim 29, wherein the media guide further comprises a protrusion disposed on a second, different surface of the media guide, the protrusion configured to mate with a corresponding portion of the printer to align the cartridge within the printer.

31. The cartridge as in claim 11, wherein the media guide comprises a window exposing a portion of the media.

* * * * *